US005457967A

United States Patent [19]

Scherzinger

[11] Patent Number: 5,457,967

[45] Date of Patent: Oct. 17, 1995

[54] DRAW-OFF DEVICE WITH ADJUSTABLE TENSION FOR CIRCULAR KNITTING MACHINE

[75] Inventor: Werner Scherzinger, Bisingen, Germany

[73] Assignee: SIPRA Patententwicklungs und Beteiligungsgesellschaft mbH, Albstadt, Germany

[21] Appl. No.: 217,676

[22] Filed: Mar. 25, 1994

[30] Foreign Application Priority Data

Mar. 30, 1993 [DE] Germany ..... 9304846 U

[51] Int. Cl.[6] ..... D04B 15/88

[52] U.S. Cl. ..... 66/151; 242/180 CS; 242/415; 474/111; 66/153

[58] Field of Search ..... 66/149 R, 151, 66/152, 153; 139/DIG. 1; 242/18 CS, 415; 474/17, 111, 113, 114, 136

[56] References Cited

U.S. PATENT DOCUMENTS

| | | | |
|---|---|---|---|
| 205,414 | 6/1878 | Porter et al. | 474/136 |
| 2,171,741 | 9/1939 | Cohn et al. | 474/17 X |
| 2,649,811 | 8/1953 | Noe | 66/149 R |
| 2,760,362 | 8/1956 | Trumpio | 66/149 R |
| 2,979,587 | 2/1961 | Estes | 474/113 X |
| 2,986,353 | 5/1961 | McCoy | 242/415 X |
| 3,070,319 | 12/1962 | Mackie | 242/18 CS |
| 3,136,169 | 6/1964 | Karger et al. | 474/111 X |
| 3,504,560 | 4/1970 | Wunsch | 474/17 X |
| 5,176,581 | 1/1993 | Kumm | 474/136 X |

FOREIGN PATENT DOCUMENTS

| | | | |
|---|---|---|---|
| 0092149 | 10/1983 | European Pat. Off. . | |
| 915696 | 11/1946 | France . | |
| 3213950 | 10/1983 | Germany . | |
| 3601825 | 7/1986 | Germany . | |
| 8800999 | 11/1988 | Germany . | |
| 4289251 | 10/1992 | Japan | 66/153 |
| 538878 | 8/1941 | United Kingdom . | |
| 624622 | 6/1949 | United Kingdom . | |
| 1041336 | 7/1966 | United Kingdom . | |
| 1157519 | 7/1969 | United Kingdom . | |
| 2170230 | 7/1986 | United Kingdom . | |

*Primary Examiner*—John J. Calvert
*Attorney, Agent, or Firm*—Michael J. Striker

[57] ABSTRACT

A draw-off device for taking down flexible goods with a steplessly adjustable draw-off tension from a machine producing or processing the goods, the draw-off device has at least one draw-off roller, a drive source, and a V-belt transmission connecting the draw-off roller and the drive source for driving the draw-off roller, the transmission comprising a V-belt pulley having two conical flanges, at least one of the flanges being mounted so as to be axially movable so as to alter an effective diameter of the V-belt pulley, the at least one movable flange being biased by spring force in direction of the other of the flanges, a V-shaped belt at least partially wrapping the V-belt pulley, at least one tensioning roller for and at least partially wrapped by the V-belt, a unit for adjusting the tensioning roller in a preselected position in order to adjust the take-down tension to a preselected value by a respective displacement of the at least one movable flange, and a locking unit for holding the tensioning roller in the preselected position.

11 Claims, 3 Drawing Sheets

DRAW-OFF DEVICE WITH ADJUSTABLE TENSION FOR CIRCULAR KNITTING MACHINE

This invention relates to a draw-off device for drawing-off flexible goods, particularly textile goods, with a stepless adjustable draw-off tension, from a machine producing or processing the goods. It also relates to a circular knitting machine provided with such a device.

BACKGROUND OF THE INVENTION

Draw-off devices, also called take-down devices, of this kind are known especially in warp knitting machine (U.S. Pat. Nos. 2,649,811, 2,760,362) and comprise at least one take-down roller, a drive source and a transmission connecting the take-down roller and the drive source. The transmission is or comprises a V-belt transmission which includes a V-belt pulley formed as a control pulley, with two conical flanges, of which at least one is mounted so as to be axially movable, in order to alter the effective diameter of the V-belt pulley, a V-shaped belt at least partially wrapping round the V-belt pulley and a device for adjusting the take-down tension, by means of which a displacement of the movable flange can be effected through alteration of the tension in the V-belt. Such draw-off devices serve for stepless adjustment of the winding-up speed of a winding-up roller, at the same time however to adjust for different tensions in the goods taken down. The V-belt pulley there consists of two immovable conical flanges, between which an axially movable further flange which is conical on both sides is arranged. Two adjacent V-shaped sections thereby result for reception of a V-shaped belt in each, which belts centre between the movable and an associated fixed flange. The effective diameter of each section thus depends on the instantaneous axial position of the movable flange. This position can be affected by a displacement radially relative to the running direction of the two V-belts or by tilting the V-belt pulley, since the tension of one V-belt is thereby momentarily increased and the tension of the other V-belt is momentarily reduced. The inequality thereby created automatically results in corresponding displacement of the movable flange and corresponding alteration of the effective diameters of the two sections of the V-belt pulley. Accordingly the relative speeds of circulation of the two V-belts alter and the transmission ratio of the V-belt drive or the overall drive including the same alters.

The described V-belt drive is comparatively complex and sensitive. It further requires the use of a tilting or shift mechanism for the V-belt or control pulley as well as the use of two V-belts to compensate for the shifting or like displacement of the axis of the V-belt pulley. Both of these are not always desirable. The cited disadvantages can it is true be partially avoided by use of another known V-belt drive (FR 915 696, DE 88 00 999 U1, DE 3 213 950 A1, DE 3 601 825 A1) but with this a manual change in the diameter of the V-belt pulley is necessary with the take-down mechanism at rest, which is likewise troublesome and in most cases undesirable.

SUMMARY OF THE INVENTION

It is an object of this invention to design the take-down or draw-off device of the kind initially defined such that the drawbacks mentioned above can be avoided.

A further object of this invention is to provide a draw-off device which can work with only one V-belt.

Yet another object of this invention is to suggest a draw-off device of a comparatively simple construction.

Another object of this invention is to design the draw-off device such that it facilitates changing the draw-down tension with the V-belt pulley in operation.

These and other objects of the invention are solved with the draw-off device of this invention which is characterized in that the movable flange is biased by spring force in the direction of the other flange and in that the device for adjusting the take-down tension comprises at least one separate, adjustable tensioning roller for the V-belt.

The invention has the advantage that the axial spacing of all transmission components is always the same, regardless of the adjusted take-down force. To alter the take-down tension it is merely necessary to alter the position of the tensioning roller acting on the V-belt, which has no effect on the kinematics and geometry of the transmission as a whole. Moreover, a constructionally simpler design, cost-effective manufacture and fitting, high operating reliability and stepless, simple and reproducible adjustment and alteration of the take-down tension result. Apart from this, it is evident that the take-down device facilitates positive take-down of goods, without slip and takes down an amount of goods in fixed relationship to the instantaneous machine speed, independently of this speed.

Moreover it is evident that the expression "rope form" shall include all flexible goods, especially thread, web or tubular goods and textile fabrics, which can be taken down with take-down devices of the kind involved here.

BRIEF DESCRIPTION OF THE DRAWINGS

The invention will now be explained in more detail in conjunction with the accompanying drawings of an embodiment, in which.

DESCRIPTION OF PREFERRED EMBODIMENTS

Figure 1:
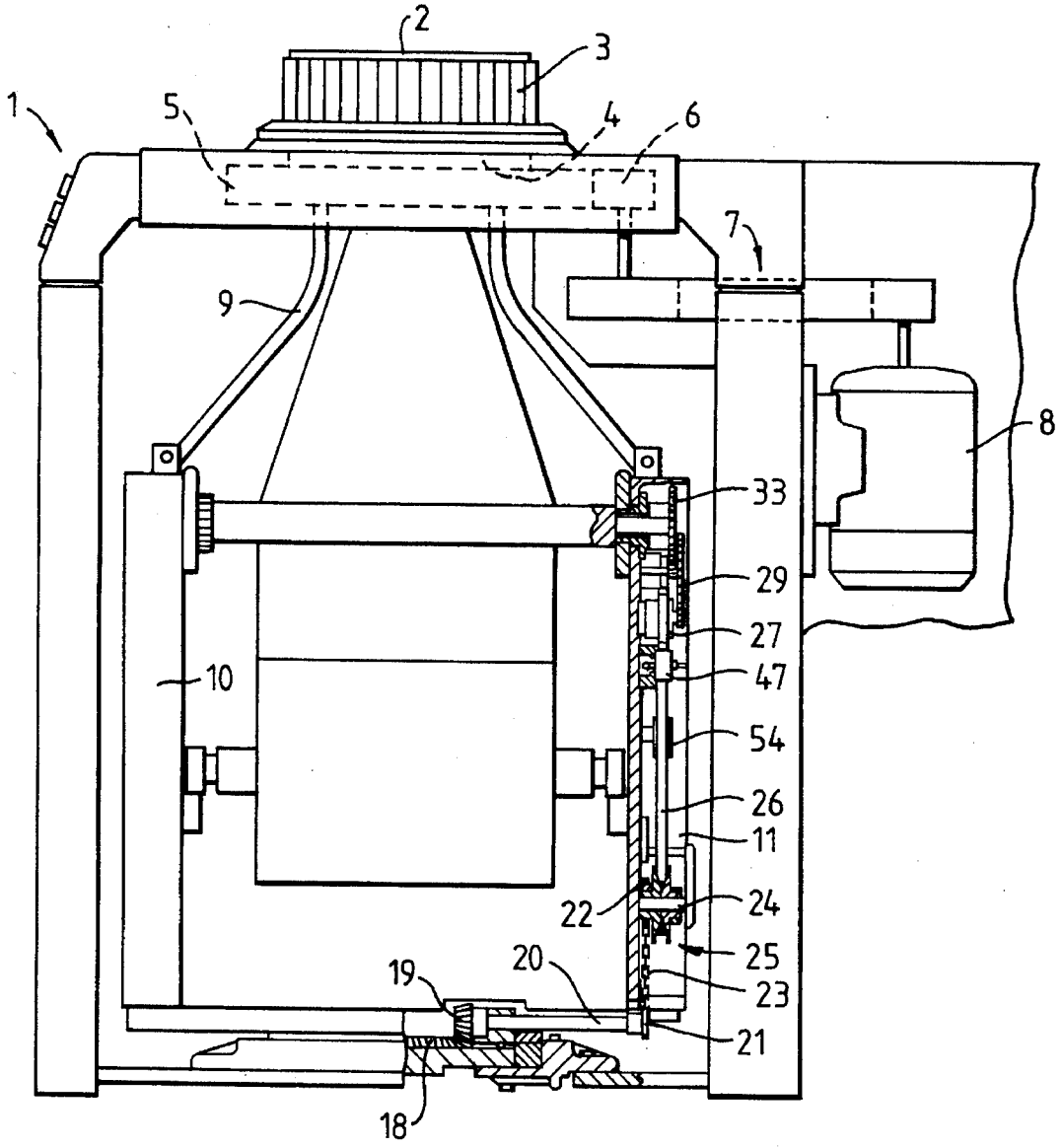
FIG. 1 is a schematic side view of a circular knitting machine with a take-down device according to the invention.
Figure 2:
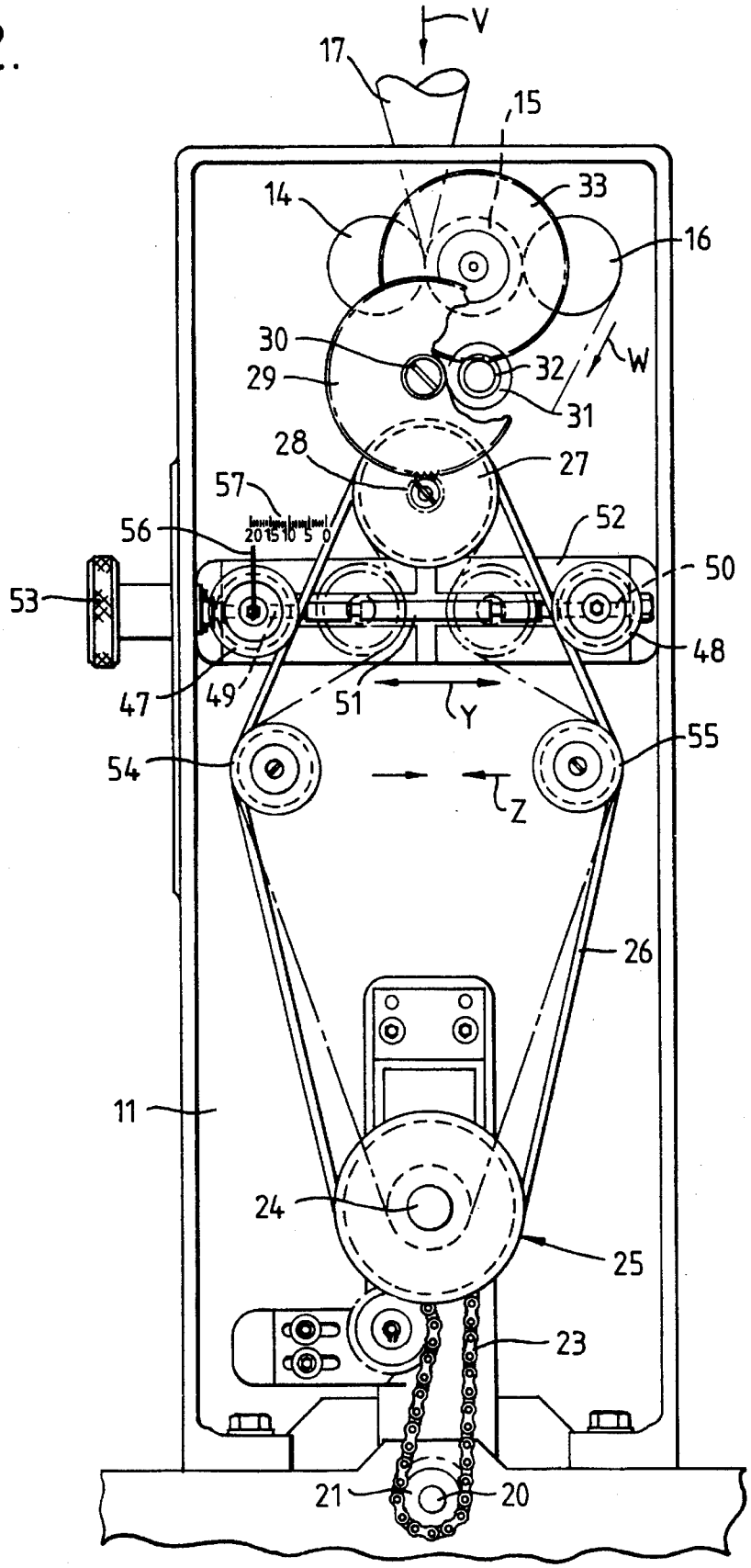
FIG. 2 is a schematic front view of only the transmission according to the invention of the take-down device on a larger scale than FIG. 1.

FIGS. 1 and 2 show a conventional circular knitting machine with a machine frame 1, a rotatable needle cylinder 2 and fixed locks 3. The needle cylinder 2 is fixed on a support ring 4, which is mounted rotatably in the machine frame 1, is formed at its outer periphery as a ring gear 5 and is coupled to a drive pinion 6, which can be rotated through a gearbox 7 by a drive motor 8.

Two carrier arms 9 are fixed to the support ting 4 and extend e.g. vertically downwards in the machine frame 1 and are fixed at their lower, free ends to two uprights 10,11. A draw-off or take-down device, is arranged between the uprights and rotates as a whole with the rotation of the support ring 4 and needle cylinder 2.

The take-down device normally includes two, preferably three positively driven take-down or draw-off rollers 14, 15 and 16. Their ends are rotatably mounted in the uprights 10,11 and form gaps (FIG. 2), between which goods, here tubular goods 17 produced in the circular knitting machine are taken down in the direction of the arrows v and w. The goods 17 normally pass hence to a winding up device, which is not shown here because it is of no significance to the invention and can even be omitted.

Circular knitting machines of the kind described are generally known to the man skilled in the art and do not therefore need to be explained in more detail.

The take-down rollers 14, 15 and 16 are driven by a drive source and a transmission arranged between them and the drive source. The drive source is here a stationary bevel gear 18 fixed to the bottom of the machine frame 1 (FIG. 1 ), on which a bevel gear 19 rolls with rotation of the support ring 4, and is fixed to one end of a shaft 20 rotatably mounted on the upright 11 and driving this shaft. The shaft 20 carries a sprocket 21 which is aligned with a sprocket 22 and is coupled thereto by a drive chain 23. The sprocket 22 is fitted on a shaft 24, to which is also fitted a V-belt pulley 25 formed as a control pulley and which is at least partially wrapped round by a V-belt 26. The V-belt also passes partially round a second, non-varying pulley 27. A pinion 28 is fixed to this and drives a gearwheel 33 through further gearwheels or pinions 29, 30, 31 and 32, the gearwheel 33 being fitted on the shaft carrying the take-down roller 15 and driving the take-down roller 15. This is coupled in a manner known per se to the two other take-down rollers 14 and 16 so that these are also driven. The parts 19 to 33 are advantageously so mounted on the upright 11 or supports connected thereto that they perform a circulating movement when the support ring 4 is set in rotation. The relative positions of the various components are apparent from FIGS. 1 and 2.

The parts 19 to 33 form a transmission which couples the bevel gear 18 forming the drive source to the take-down roller 15. It comprises a V-belt transmission formed from the parts 25, 26 and 27, determines the transmission ratio between the bevel gear 19 and the take-down rollers 14, 15 and 16 and thus between these and the needle cylinder 2 and thus determines in known manner the tension under which the goods 17 are held in being taken down from the needle cylinder 2.

Figure 3:
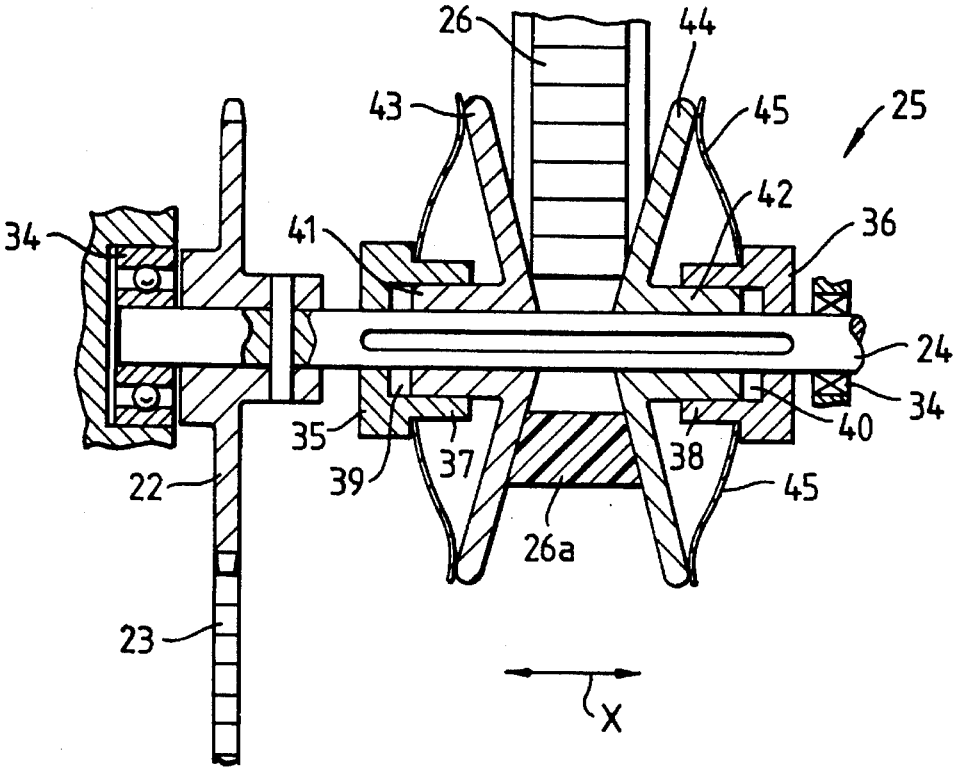
FIGS. 3 and 4 are further enlarged sections through the V-belt pulley of the transmission according to FIGS. 1 and 2 in two different positions.
Figure 4:
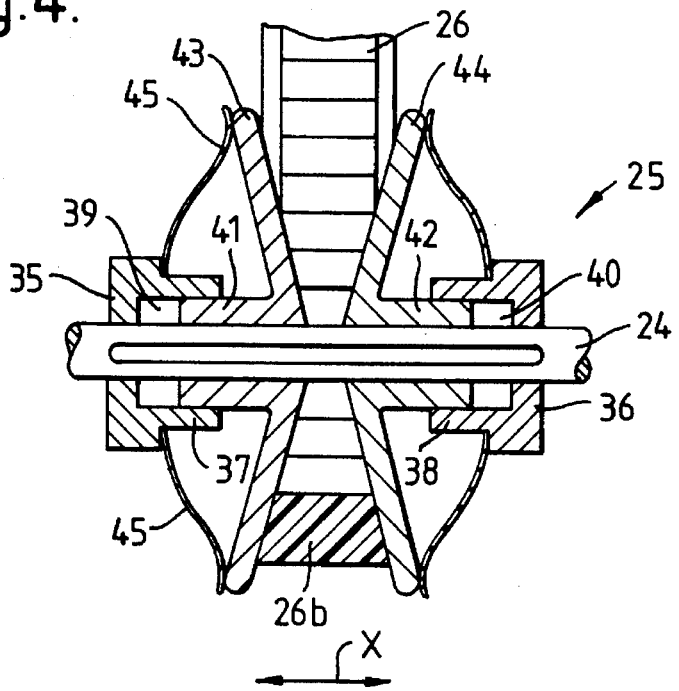

In order to effect the stepless adjustment of the take-down tension it is provided in accordance with the invention to make the V-belt pulley 25 in accordance with FIGS. 3 and 4. Accordingly two side plates 35,36 are fixed on the shaft 24, which is mounted rotatably in bearings 34 fitted to the upright 11, on which plates are formed or mounted facing sleeves 37,38 coaxial with the shaft 24. The sleeves 37,38 have a somewhat larger inner diameter than the outer diameter of the shaft 24 and therefore form annular spaces 39 and 40. A guide collar 41,42 is arranged in each of these and each collar 41,42 is mounted to be axially movable but rotationally fast with the shaft 24, by means of groove and key connection or the like. A coaxial, conical flange 43,44 is fixed to each of the guide collars 41,42, being so inclined relative to the shaft 24 that the two flanges 43,44 together form a V-shaped receiving channel for the V-belt 26, likewise V-shaped.

The two flanges 43 and 44 are biased by means of springs 45 in the shape of or formed into a star in the direction towards one another, the springs 45 abutting corresponding shoulders of the side plates and flanges, 35,36 and 43,44 respectively. On account of the axial movability of the guide collars 41,42 however, the flanges 43,44 can be pushed axially apart in the direction of a double arrow x, spreading the springs 45, until the guide collars 41,42 abut the side plates 35,36.

In the position according to FIG. 3 the flanges 43,44 have a comparatively large spacing, with the result that the V-belt 26 assumes a position 26*a*, in which it has a small spacing from the axis of the shaft 24. This corresponds to a small effective diameter of the V-belt pulley 25. On the other hand FIG. 4 shows that the flanges 43,44 can also have a comparatively small spacing. In this case the V-belt 26 assumes a position 26*b*, in which it has a comparatively large radial spacing from the shaft 24, which corresponds to a large effective diameter of the V-belt pulley 25. Commencing from FIG. 3, the position of the V-belt pulley 25 automatically becomes that of FIG. 4 under the action of the springs 45, when the tension in the V-belt 26 falls off.

Automatic control over the effective diameter of the V-belt pulley 25 is thus possible inter alia in that the tension of the V-belt 26 is increased or reduced. This is made use of in accordance with the invention by an arrangement of at least one tensioning roller 47 which is at least partially wrapped round by the V-belt 26. In the embodiment shown in FIG. 2 there is a second tensioning roller 48, the tensioning rollers 47,48 having axes parallel to the axes of the V-belt pulleys 25,27 and also advantageously being operative in the same plane as these.

The tensioning rollers 47,48 are rotatably mounted according to FIG. 2 on sliders 49,50. The sliders 49,50 are provided with internally threaded parts and sections of a threaded spindle 51 pass through these. The slider 49 and the associated section of the threaded spindle 51 are provided with right hand threads and the slider 50 and the associated section of the threaded spindle 51 are provided with left hand threads, although the converse arrangement is possible. Accordingly rotation of the threaded spindle in one direction results in the sliders 49 and 50 closing together whereas rotation in the other direction results in the sliders 49,50 moving apart from each other. The axes of the tensioning rollers 47,48 are thus arranged perpendicular to the direction of movement of the sliders 49,50.

In order to avoid the sliders 49,50 turning with the threaded rod 51 when this is turned, they are mounted slidably but non-rotatably in guides, which are formed in a bar 52 fixed to the upright 11. The bar 52 also has supports at its ends for rotatable mounting of the threaded spindle 51, which is provided with a hand-wheel 53 at one end.

As FIG. 2 shows, the V-belt 26 can be further guided between the V-belt pulleys 25,27 via two guide rollers 54,55, so that it describes in all a somewhat trapezoidal or rhomboidal path. The tensioning rollers 47,48 engage e.g. from the outside on the sections located between the guide rollers 53,54 and the V-belt pulley 27. They run essentially in a straight line or are relaxed with the tensioning rollers 47,48 fully retracted (full-line position in FIG. 2) and which are inwardly bowed and correspondingly tensioned (broken line position in FIG. 2) with the tensioning rollers 47,48 fully advanced.

The adjustment of the take-down tension in the goods takes place in the following manner:

If a higher take-down tension is required, the tensioning rollers 47,48 are separated from one another in the direction of a double arrow X, until they assume for example the position shown in FIG. 2 in full lines. This corresponds, as also shown in FIG. 2 in full lines, to a large diameter of the V-belt pulley 25, whose flanges 43,44 are pressed close together by the springs 45 on account of the small tension in the V-belt 26 (FIG. 4). A consequence of this is that the driven V-belt pulley 27 turns faster and the goods 17 are taken down more rapidly. Should the take-down tension be on the contrary reduced, the tensioning rollers 47,48 are moved towards each other in the direction of a double arrow z by suitable rotation of the threaded spindle 51, until they assume their position shown in broken lines in FIG. 2 for example. This corresponds, as is also shown in broken lines in FIG. 2, to a small diameter of the V-belt pulley 25, because in this case the V-belt 26 pushes the flanges 43,44 away from each other against the force of the springs, on account of its higher tension (FIG. 3). In consequence the V-belt pulley 27 is driven more slowly and the goods 17 are taken down more slowly. Moreover, in each case the position of the tensioning rollers 47,48 which is established is automatically held because of the self-locking created by the threads, so that no special locking devices need be provided.

In this connection, a substantial advantage of the invention is to be seen in that each tensioning rollers 47,48 bears on the V-belt 26 between two fixed rollers 27,54,55, so that fine adjustment of the take-down tension is obtained without altering the axial spacing of the V-belt pulleys 25,27.

A pointer 56 fitted to one of the tensioning rollers (e.g. 47) with an associated scale 57 can serve for reproducible creation of a preselected take-down tension.

The invention is not limited to the described embodiment, which can be modified in many ways. For example, it is possible to provide only one tensioning roller for the V-belt 26 and to provide other means for adjustment of the tensioning roller(s). In particular it is possible to mount the tensioning roller(s) on pivotable levers and to provide them with a locking device. It would further be possible to make the driven V-belt pulley 27 the control pulley instead of the driving V-belt pulley 25. Moreover the transmission as a whole could be designed differently than in FIG. 2. In particular it would be conceivable to provide as the transmission only the described V-belt transmission, e.g. if the take-down device is used in machines other than circular knitting machines, e.g. flat knitting machines, warp knitting machines, cotton machines, weaving machines or the like, or to draw-off other goods, especially threads or web form materials or other flexible goods. In this case the drive source could also act directly on the V-belt pulley 25. Finally it would also be possible to arrange only one of the two flanges 43,44 in the V-belt pulley 25 to be movable, the other in contrast being arranged immovably, insofar as the resultant slight sideways displacements of the V-belt 26 on altering the effective diameter of the V-belt pulley 25 are not a problem in the context of the overall arrangement.

I claim:

1. A draw-off device for taking down flexible goods with a steplessly adjustable draw-off tension from a machine producing or processing the goods, the draw-off device comprising at least one draw-off roller; a drive source; and a V-belt transmission connecting said draw-off roller and said drive source for driving said draw-off roller, said transmission comprising a V-belt pulley having two conical flanges, at least one of said flanges being mounted so as to be axially movable so as to alter an effective diameter of said V-belt pulley, said at least one movable flange being biased by spring force in direction of the other of said flanges, a V-shaped belt at least partially wrapping said V-belt pulley, at least one tensioning roller for and at least partially wrapped by said V-belt, means for adjusting said tensioning roller in a preselected position in order to adjust said take-down tension to a preselected value by a respective displacement of said at least one movable flange, and locking means for holding said tensioning roller in said preselected position.

2. A draw-off device as defined in claim 1, wherein said flanges of said V-belt pulley are axially movable.

3. A draw-off device as defined in claim 1; and further comprising springs biasing said two flanges in direction toward one another.

4. A draw-off device as defined in claim 1, wherein said V-belt pulley is a driving V-belt pulley.

5. A draw-off device as defined in claim 1, wherein said device has two such tensioning rollers for said V-belt.

6. A draw-off device as defined in claim 5; and further comprising means forming two fixed positions, said tensioning rollers acting on said V-belt between said two locations.

7. A draw-off device as defined in claim 1, wherein said adjusting and locking means comprising at least one spindle mounted on a guide and movable by a threaded spindle to form a bearing for said tensioning roller.

8. A draw-off device as defined in claim 7, wherein said threaded spindle has one section having a right hand thread and another section having a left hand thread, said device having two tensioning rollers provided for said V-belt and arranged one after the other on said two sections of said threaded spindle.

9. A draw-off device according to claim 1, wherein said locking means are self-locking means.

10. A circular knitting machine comprising a machine part for knitting flexible goods; a draw-off device for taking down the flexible goods with a steplessly adjustable draw-off tension from said knitting machine part, said draw-off device comprising at least one draw-off roller, a drive source, and a V-belt transmission connecting said draw-off roller and said drive source for driving said draw-off roller such that said flexible goods are taken down with a preselected constant draw-off tension, said transmission comprising a V-belt pulley having two conical flanges, at least one of said flanges being mounted so as to be axially movable so as to alter an effective diameter of said V-belt pulley, said at least one movable flange being biased by spring force in direction of the other of said flanges, and a V-shaped belt at least partially wrapping said V-belt pulley, at least one tensioning roller for and at least partially wrapped by said V-belt, means for adjusting said tensioning roller in a preselected position in order to adjust said preselected take-down tension by a respective displacement of said at least one movable flange, and locking means for holding said tensioning roller in said preselected position.

11. A circular knitting machine part according to claim 10, wherein sad locking means are self-locking means.

* * * * *